US005528252A

United States Patent [19]

Skahill

[11] Patent Number: 5,528,252

[45] Date of Patent: Jun. 18, 1996

[54] DIPOLE TELEVISION ANTENNA

[75] Inventor: George Skahill, Greenlawn, N.Y.

[73] Assignee: NTL Technologies Inc., Greenlawn, N.Y.

[21] Appl. No.: 329,328

[22] Filed: Oct. 26, 1994

[51] Int. Cl.[6] ..... H01Q 9/16

[52] U.S. Cl. ..... 343/822; 343/821; 343/820

[58] Field of Search ..... 343/822, 820, 343/821, 823, 790, 791, 792, 850, 851, 859, 860, 803, 806, 876; H01Q 9/16

[56] References Cited

U.S. PATENT DOCUMENTS

| | | | |
|---|---|---|---|
| 3,064,257 | 11/1962 | Guest | 343/802 |
| 3,228,031 | 1/1966 | Kitamura et al. | 343/805 |
| 3,653,056 | 3/1972 | Peterson | 343/795 |
| 4,038,662 | 7/1977 | Turner | 343/752 |
| 4,201,990 | 5/1980 | Altmayer | 343/822 |
| 4,308,540 | 12/1981 | Winegard et al. | 343/749 |
| 4,479,130 | 10/1984 | Snyder | 343/822 |

*Primary Examiner*—Hoanganh Le

*Attorney, Agent, or Firm*—R. Neil Sudol; Henry D. Coleman

[57] ABSTRACT

A television antenna device comprises a pair of electrically conductive dipole arms, a support attached to the dipole arms for supporting the dipole arms, and an electrical circuit operatively connected to each of the dipole arms and mounted to the support for tuning the dipole arms for an optimal impedance match over a plurality of different frequency ranges. A switch is operatively connected to the electrical circuit and is mounted to the support for enabling adjustment of a circuit configuration including the electrical circuit and the dipole arms to selectively tune the dipole arms for an optimal impedance match over the plurality of different frequency ranges. Each of the dipole arms includes a pair of coaxial series tuned circuits for suppressing current flow over electromagnetic frequencies corresponding to higher VHF channels.

25 Claims, 3 Drawing Sheets

DIPOLE TELEVISION ANTENNA

BACKGROUND OF THE INVENTION

This invention relates to a television antenna. More particularly, this invention relates to a television antenna of the dipole type.

An efficient set-top television antenna must be designed while keeping in mind many considerations in practical electromagnetics. Dipole antennas for receiving commercial television broadcasts must satisfy or balance among many inharmonious engineering requirements. For example, an all-channel antenna must be capable of adequately receiving signals across a broad spectrum of frequency ranges which extend from a band of 54 MHz to 72 MHz, in 6 MHz increments (Channels 2, 3, and 4), to a UHF band of 470 MHz to 890 MHz, in 6 MHz increments (Channels 14 through 83). For each of the lowest numbered channels, because the channel bandwidth exceeds 10 percent and wavelength exceeds 16 feet, dipole antennas sized for set-top installation exhibit such highly capacitative and high Q impedance properties that individual channel matching circuits are needed to increase the amount of broadcast signal delivered to the receiver. For the highest numbered channels, because bandwidth is less than one percent and wavelength is less than 14 inches, antennas sized for set-top installation can exhibit inherently satisfactory impedance properties over a frequency range encompassing many channels, often the entire UHF broadcast band.

A basic problem in attempting a set-top design that receives all VHF and UHF broadcast channels efficiently is that an antenna with an electrical extent large enough to facilitate impedance matching at each of the lowest frequency channels, particularly Channels 2 and 3, has such a large electrical extent at the highest frequency channels that the radiation patterns can exhibit sizeable frequency variations, leading to amplitude and/or phase weightings of a received broadcast signal over its frequency band and substantially diminished quality of reception. Additionally, the small electrical extent of a set-top dipole antenna at each of the lower frequency channels ensures a low value of radiation resistance while, at the higher VHF channels, its electrical extent can approach a wavelength, ensuring a high value of radiation resistance. In summary, the antenna's electrical extent is too little at low VHF because of low resistance levels, too large at high VHF because of the high resistance levels, and much too large at UHF because of pattern dispersions. The superposition of an antenna configuration that can perform well at Channel 2 with one that can perform well at Channels 3, 4, etc., and can be easily reconfigured for efficient operation at any channel is a demanding requirement because of the inharmonious factors and the resulting inharmonious engineering requirements.

A basic problem in set-top antenna design arising from these inharmonious engineering requirements is that the antenna's electrical extent is generally too little in one band and too large in another. Because of the large wavelengths and appreciable percentage bandwidths required in the lowest frequency channels (2 and 3), efficient reception in these channels, which depends on the antenna's size in wavelengths, conflicts with its height, its width and the length of its dipole arms. The super-position of an antenna configuration that can perform well at Channel 2 with one that can perform well at Channels 3 and 4, etc. and can be easily reconfigured for efficient operation at any channel is a demanding requirement.

In dipole antenna assemblies, the antenna is connected to a transformer via a balanced two-wire transmission line. The transformer is in turn connected to the television antenna input port via an unbalanced coaxial transmission line. The devices for transforming from balanced to unbalanced transmission lines (baluns) must be very large to operate efficently at the lower frequencies or must employ ferrite devices that result in attenuation at the higher frequencies. Similarly, some of the circuit components used in "broadband" matching over the extent of each channel at lower frequencies can be sizable or can use ferrite devices with attenuation at lower frequencies.

Improving the reception range of indoor, set-top television antennas is limited by the available height above ground and the achievable antenna gain, particularly at the low frequency channels. Actually, given the size limitations that must be imposed on set-top antennas, the only feasible improvements are in the efficiency of the antenna in extracting the maximum broadcast signal from the air and in delivering that signal to the television receiver.

It has been discovered that most fully extended rabbit-ear type antennas are at least 10 dB deficient at Channel 2 compared with a reference high quality dipole configured for a frequency of 57 MHz. It is likely that a major cause of this low efficiency is radio-frequency attenuations between interconnected sections of the telescoping tubes of the antenna. It is also possible that these losses increase with time and use.

It appears that the conventional rabbit-ear antenna is in need of replacement with an updated or improved design.

OBJECTS OF THE INVENTION

An object of the present invention is to provide an improved set-top television antenna.

Another object of the present invention is to provide a set-top television antenna, different from the conventional rabbit-ear design, which lends itself to reconfiguration by the consumer. Such an adjustable design should have a better efficiency than the conventional rabbit-ear design.

A further object of the present invention is to provide a set-top television antenna which operates efficiently in several frequency bands, particularly when the space available is limited and the antenna falls into the category of "electrically small" at the lower frequencies.

An additional object of the present invention is to provide a set-top television antenna with an improved reception range and/or improved efficiency.

These and other objects of the present invention will be apparent from the drawings and detailed descriptions herein.

SUMMARY OF THE INVENTION

For Channel 2, a truly efficient design in a dipole antenna would extend over a length exceeding four feet and would incorporate broadband matching circuitry. A less efficient configuration, but one that is more efficient than current set-top antennas, extends over a lesser length, perhaps two to three feet, and employs series inductances to balance the antenna's highly capacitative input impedance. The resulting input impedance characteristic is similar to that of a series RLC circuit with resonance (zero reactance) near Channel 2's midband at 57 MHz. The series inductances may be located entirely at the feed point, entirely at points along the dipole arms or partly at the feed point and partly along the dipole arms.

For Channel 3, lesser values of series inductance will balance the dipole antenna's capacitative input, resulting in an input impedance characteristic similar to that of an RLC circuit with resonance near Channel 3's midband at 62 MHz. Because the dipole's extent is a larger fraction of a wavelength at Channel 3 than at Channel 2, the resistance level of the circuit will be larger. Similarly, a further reduction in series inductance will configure the antenna successively for resonance at Channels 4, 5, and 6. Channels 5 and 6 span the frequency range of 76 MHz to 88 MHz and a single value of series inductance will provide performance in both channels comparable to that achieved by dedicated values in the lower channels.

The total frequency extent of the middle Channels 7 through 13 is approximately 24 percent and wavelengths are in a range of about 5 feet. Efficient operation over that entire bandwidth can be achieved with antenna units spanning about a half wavelength without the need for series inductance as used to control the input impedance at lower channels. Care must be exercised to prevent the antenna's electrical extent from becoming much larger than about one wavelength at the higher frequencies, a situation that can result in unpleasant frequency dependent lobeyness in the antenna patterns as well as high resistance levels of the input impedance characteristics. High resistance levels are not inherently problematical in broadband antenna design, but in set-top dipole antennas where resistance levels are necessarily low at the lower numbered channels, high resistance levels can require additional compromises and design complexities.

Above Channel 13, a television dipole antenna for set-top installation is large enough to ensure efficent reception provided that the underlying design has the inherent bandwidth needed to support the frequency extent of nearly 2:1 of the UHF channels. In this range, percentage bandwidth of any one channel is small enough to eliminate single channel frequency effects, but a frequency dependent lobeyness in the radiation pattern will occur and may require occasional reorientation of the antenna for reception of different channels.

A television antenna device comprises, in accordance with the present invention, a pair of electrically conductive dipole arms, a support attached to the dipole arms for supporting the dipole arms, and an electrical circuit operatively connected to each of the dipole arms and mounted to the support for tuning the dipole arms for an optimal impedance match over a plurality of different frequency ranges. A switch is operatively connected to the electrical circuit and is mounted to the support for enabling adjustment of a circuit configuration including the electrical circuit and the dipole arms to selectively tune the dipole arms for an optimal impedance match over the plurality of different frequency ranges.

According to another feature of the present invention, the antenna device further comprises coupling componentry for coupling the dipole arms to a television receiver via the electrical circuit. That circuit includes a plurality of paired first and second inductors, where the first and second inductor of each pair of inductors have a common inductance and where the inductors of each pair differ in inductance from the inductors of other pairs. The switch includes means for selectively connecting the dipole arms to the coupling componentry via alternate pairs of the first and second inductors so that the first inductor of a pair is operatively connected in one circuit configuration to one of the dipole arms and the associated second inductor is operatively connected in another circuit configuration to the other of the dipole arms.

According to a more specific feature of the present invention, all of the first inductors are connected in parallel with one another and all of the second inductors are connected in parallel with one another. The inductors preferably take the form of ferrite inductors.

It is contemplated that the coupling componentry includes a balun transformer and a balanced two-wire transmission line connected at one end to the switch and at an opposite end to the balun transformer. In addition, an unbalanced coaxial transmission line extends from the balun transformer, while a connector is provided at one end of the unbalanced coaxial transmission line for operatively linking the unbalanced coaxial transmission line to the television receiver. In this configuration, the balun transformer is preferably a ferrite component with an impedance ratio of 1:1.

According to a further feature of the present invention, the support includes a base part and tubular vertical extension connected to the base part. The dipole arms extend from an upper end of the tubular vertical extension. Also, the extension houses the balun transformer, the electrical circuit, and at least a portion of the switch.

Preferably, the coupling componentry includes a mechanical single-pole double-throw switch for alternately permitting connection of the antenna device or a video playback unit to the television receiver.

According to an additional feature of the present invention, each of the dipole arms has at least one elbow type joint for enabling a bending of the respective arm from a fully extended configuration to a completely folded back configuration.

According to yet another feature of the present invention, each of the dipole arms includes at least one coaxial series tuned circuit, and preferably two such circuits, for suppressing current flow over electromagnetic frequencies corresponding to higher VHF channels.

A television antenna device comprises, in accordance with another conceptualization of the present invention, a pair of electrically conductive dipole arms, coupling componentry for connecting the antenna to a television receiver, and a plurality of paired first and second inductors. The first and second inductor of each pair of inductors have a common inductance, while the inductors of each pair differ in inductance from the inductors of other pairs. All of the first inductors are connected in parallel with one another and all of the second inductors are connected in parallel with one another. A housing contains the inductors, while the dipole arms are mounted to the housing. A switch is mounted to the housing for alternately connecting one of the dipole arms to the coupling componentry via different ones of the first inductors and concomitantly connecting the other of the dipole arms to the coupling componentry via associated ones of the second inductors, thereby tuning the dipole arms for an optimal impedance match over a plurality of different frequency ranges.

A set-top television antenna in accordance with the present invention is different from and has a better efficiency than the conventional rabbit-ear design. Like the conventional rabbit-ear design, a set-top television antenna in accordance with the present invention lends itself to reconfiguration by the consumer.

A set-top television antenna in accordance with the present invention operates efficiently in several frequency bands, particularly when the space available is limited and the antenna falls into the category of "electrically small" at the lower frequencies.

A set-top television antenna in accordance with the present invention has an improved reception range and/or improved efficiency and performs well at any channel, notably Channels 2, 3, and 4, by simply reconfiguring the feed circuityr via a rotary switch. The antenna can perform well at Channels 2, 3 and 4 by simply reconfiguring the feed circuitry via a rotary switch.

Part of the resolution among the design conflicts is the configuration of tuned circuits in the dipole arms. These circuits extend the electrical length of the dipole arms beyond their physical lengths at lower frequencies by adding series inductance and reduce their electrical lengths at the higher frequencies by introducing current suppressing high impedance paths along their lengths. The function of the different inductor pairs is to adjust the reactive component of input impedance. At the lowest Channels 2, 3, and 4, the values of inductance are selected for zero reactance near channel mid-band. A single inductor pair is used for both Channels 5 and 6 and is selected for zero reactance near the cross-over frequency (82 MHz). The inductance value selected for Channels 7 and higher is as close as practical to zero, corresponding to a straight section of conductor as described below. Since the input impedance characteristic can be modified by the antenna's local environment, inductance values on either side of nominal ought to be tried to ensure best performance. FM radio reception can be supported as described hereinafter.

DETAILED DESCRIPTION

Figure 1:
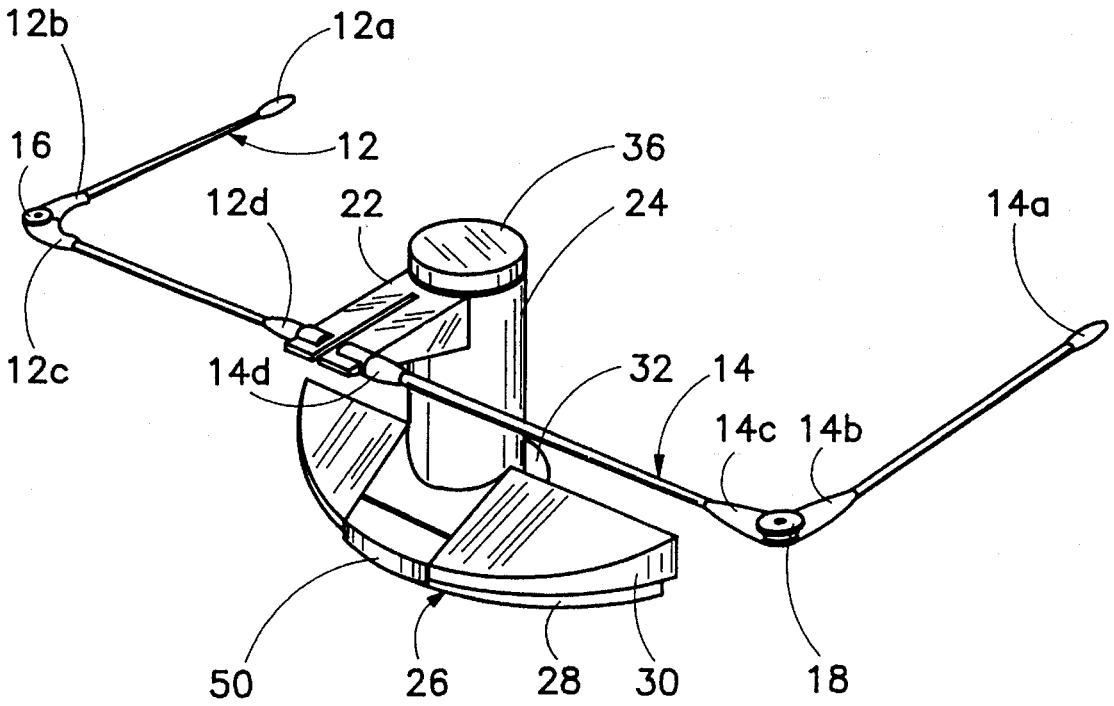
FIG. 1 is an isometric view of a set-top television dipole antenna in accordance with the present invention.
Figure 2:
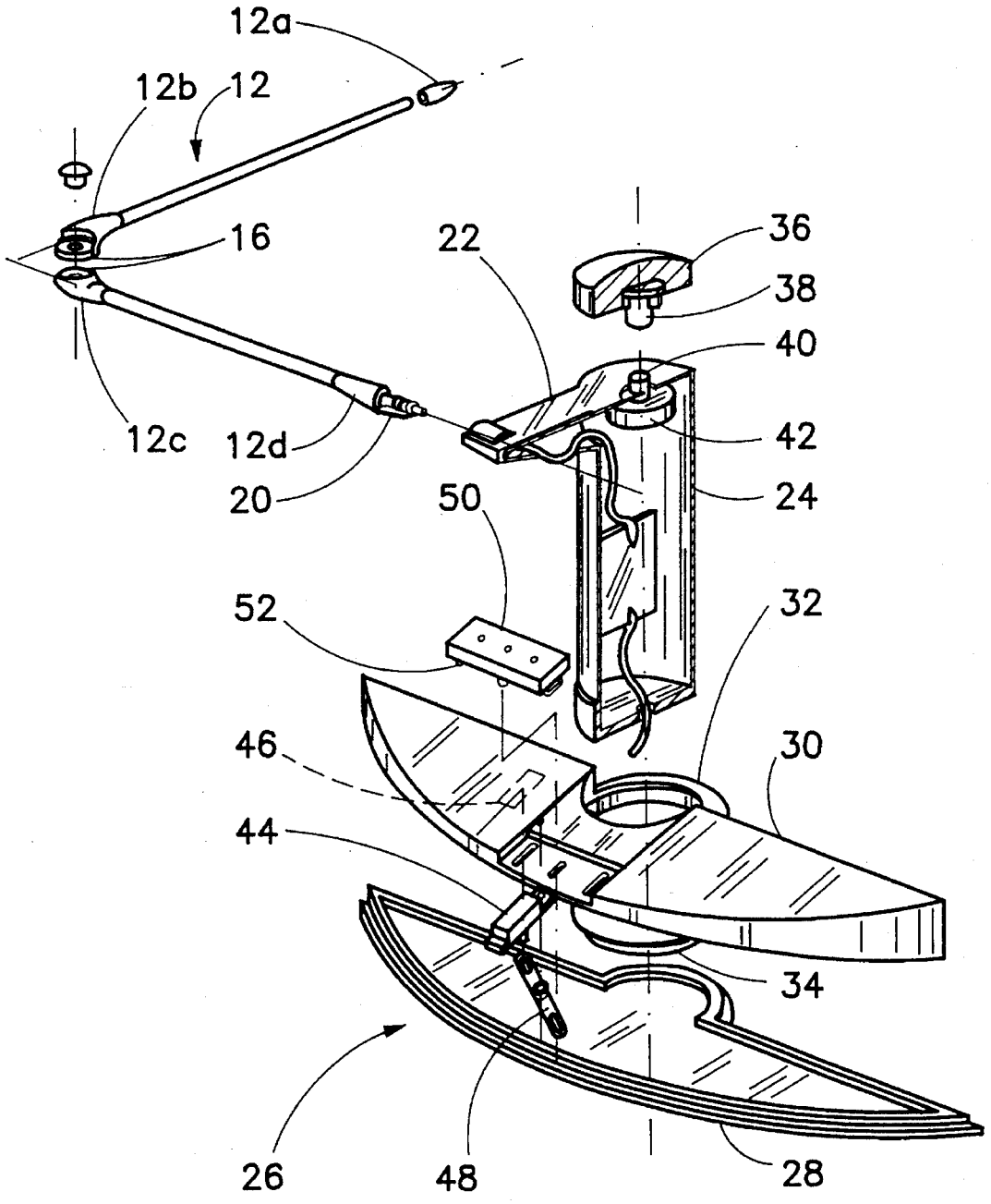
FIG. 2 is a partial exploded view of the set-top television dipole antenna of FIG. 1.

As illustrated in FIGS. 1 and 2, a set-top television antenna of the dipole type comprises a pair of electrically conductive dipole arms 12 and 14 each provided with a respective elbow type joint 16 and 18 for enabling a bending of the respective arm from a fully extended configuration to a completely folded back configuration. At an inner end, each dipole arm 12 and 14 is connected via a respective bayonnet type connector 20 (FIG. 12) to a horizontal or cantilevered bracket 22 at an upper end of a cylindrical or tubular vertical housing extension 24. Each dipole arm 12 and 14 is provided with a plurality of plastic molded end caps 12*a*, 12*b*, 12*c*, 12*d* and 14*a*, 14*b*, 14*c*, 14*d*.

Housing extension 24 is connected at a lower end to a wing shaped main housing 26 including a solid rubber molded base 28 and an upper shell or casing half 30 fitted thereto. Shell or casing half 30 is formed along a rear side with a ring 32 for receiving the lower end of tubular housing extension 24. As shown in FIG. 2, an additional ring 34 is provided for retaining tubular housing extension 24.

At its upper end, tubular housing extension 24 is provided with a rubber molded rotary tuning knob 36 having a plastic molded knob core 38 which mates with a projection 40 of a tuner or rotary switch 42 to enable manual operation of the tuner. Tuner 42 is disposed inside tubular housing extension 24 along the upper end thereof.

Main housing 26 holds a mechanical RF single-pole double-throw switch 44 which is attached at 46 to shell or casing half 30 along an underside thereof. A lever 48 operatively links switch 44 to a manually actuatable switch cap 50 which is slidably mounted to shell or casing half 30 via snap-in guide lugs 52.

Figure 3:
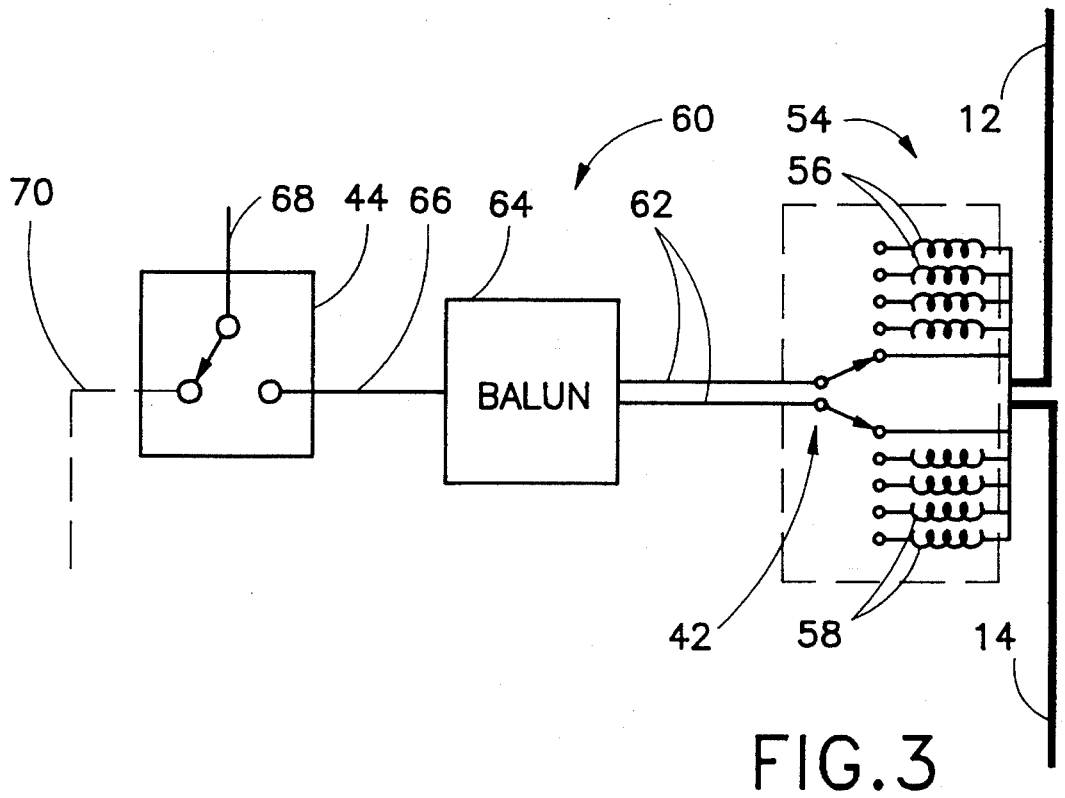
FIG. 3 is basically a block diagram of electrical components of the television antenna of FIGS. 1 and 2.

As illustrated in FIG. 3, dipole arms 12 and 14 are operatively connected to an electrical circuit 54 disposed inside and mounted to tubular housing extension 24 for tuning dipole arms 12 and 14 for an optimal impedance match over a plurality of different frequency ranges. Tuner or rotary switch 42 includes or is operatively connected to electrical circuit 54 for enabling manual adjustment of a circuit configuration including electrical circuit 54 and dipole arms 12 and 14 to selectively tune dipole arms 12 and 14 for an optimal impedance match over the plurality of different frequency ranges.

More particularly, electrical circuit 54 includes a plurality of paired first inductors 56 and second inductors 58, one pair comprising two straight wires. First inductors 56 are connected in parallel to one another and in series with dipole arm 12, while second inductors 58 are connected in parallel to one another and in series with dipole arm 14. Each first inductor 56 is paired with a respective second inductor 58 having a common inductance which is different from the inductances of the other pairs of inductors 56 and 58. Inductors 56 and 58 preferably take the form of ferrite inductors.

The antenna device further comprises coupling componentry 60 for coupling dipole arms 12 and 14 to a television receiver. Coupling componentry 60 includes a balanced two-wire transmission line 62, a balun transformer 64, and an unbalanced coaxial transmission line 66. Two-wire transmission line 62 is connected at one end to tuner or rotary switch 42 and at an opposite end to balun transformer 64. Coaxial transmission line 66 extends from balun transformer 64 to switch 44.

Balun transformer 64 is a ferrite component with an impedance ratio of 1:1, as per the ARRL Antenna Handbook. Because transformer 64 is a ferrite device, its size can be diminished compared with designs using linear circuit elements which have dimensions which are an appreciable fraction of a wavelength (approximately 18 feet at Channel 2). The 1:1 ratio is used partly because it supports the largest possible bandwidth and partly because it matches the lower channel resistance levels - - - where the match is needed more - - - better than at the higher channels where it is less important.

As further illustrated in FIG. 3, switch 44 is connected to a television receiver (not shown) via a line 68 and to a video playback unit, a cable input or other auxiliary device (not shown) via another line 70. Switch 44 is operative to permit alternate connection of the television receiver to the antenna device or to the video playback unit. Isolation in switch 44 is important since cable signals can be very much larger than those received by the antenna. In installations where the broadcast signal must compete with very powerful cable signals, additional attenuations may be installed at the cable input.

Depending on the actuation of tuning knob 36, tuner or rotary switch 42 selectively connects dipole arms 12 and 14 to coupling componentry 60 via alternate pairs of inductors 56 and 58 so that the first inductor 56 of a pair is operatively connected in one circuit configuration to dipole arm 12 and the associated second inductor 58 is operatively connected in another circuit configuration to the other dipole arm 14.

Figure 4:
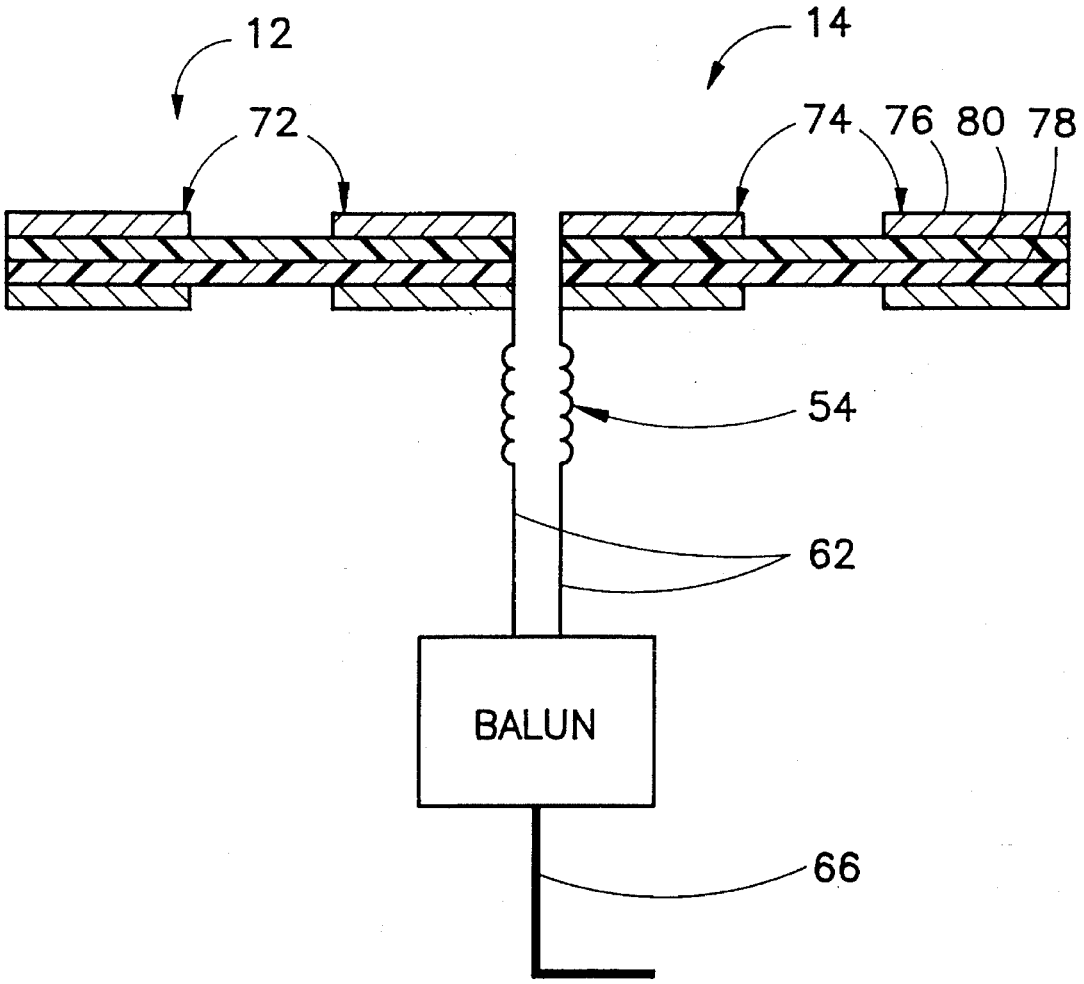
FIG. 4 is a schematic cross-sectional view of dipole arms of the antenna of FIGS. 1 and 2.

As illustrated in FIG. 4, dipole arms 12 and 14 each include a pair of coaxial series tuned circuits 72 and 74 for suppressing current flow over electromagnetic frequencies corresponding to higher VHF channels, particularly Channels 7–13. Each coaxial series tuned circuit 72 and 74 includes a cylindrical outer conductor 76, an inner conductor 78, and a cylindrical dielectric layer 80 between conductors 76 and 78. The individual circuits of each pair of coaxial series tuned circuits 72 and 74 are spaced by the elbow type joints 16 and 18, respectively. A set-top television antenna as described herein is a center-fed, bent arm dipole with provisions for adjusting the bends, which are located about halfway along each arm 12 and 14. Electrically, dipole arms 12 and 14 are coaxial cables with the outer jacket peeled away over a limited region about bendable elbow type joints 16 and 18. The internal coaxial circuits generated by this structure are terminated in short circuits at or near the cable ends, at plastic end caps 12*a* and 14*a*. Coaxial series tuned circuit pairs 72 and 74 are dispersive circuits tending to increase the effective electrical lengths of arms 12 and 14 at the lower frequencies by adding series inductance and to diminish their effective electrical length at the higher VHF frequencies by adding very large series impedances.

It is to be noted that only one or three or four coaxial series tuned circuits may be included along the length of each dipole arm 12 and 14. However, increasing the number of such circuits over two is not believed to perceptibly improve performance. It is to be further noted that over the large frequency range of UHF Channels 14–83, the series reactance added by series tuned circuits 72 and 74 varies rapidly from very large to very small and the radiation resistance, because of the relatively large extent of the antenna in wavelengths, is much larger than at the lowest channels. The antenna pattern is believed to be highly structured in angle with several azimuth nulls. However, the percentage bandwidth of any one channel is small enough that patterns will be reasonably stable over the frequency extent of any one.

As discussed above, tuner or rotary switch 42 is used to select among pairs of matched ferrite inductors 56 and 58. Those inductors 56 and 58 with the largest inductance values tune the antenna for a best possible impedance match, consistent with the small electrical size of the antenna, over the Channel 2 frequency range. Two other matched pairs of inductors 56 and 58 serve to optimize impedance matching for Channels 3 and 4, respectively. Another pair of inductors 56 and 58 is suitable for impedance matching for both Channels 5 and 6. Another pair of inductors 56 and 58 may be reserved for the FM frequency band. Inductors 56 and 58 of a final inductor pair are actually straight sections of conductor of nominally (almost) zero inductance. This smallest inductance serves to tune the antenna for an acceptable impedance match over the frequencies of Channels 7 to 83.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A television antenna device comprising:

a pair of electrically conductive dipole arms;

support means attached to said dipole arms for supporting said dipole arms;

electrical circuit means operatively connected to each of said dipole arms and mounted to said support means for tuning said dipole arms for an optimal impedance match over a plurality of different frequency ranges;

switch means operatively connected to said circuit means and mounted to said support means for enabling adjustment of a circuit configuration including said circuit means and said dipole arms to selectively tune said dipole arms for an optimal impedance match over said plurality of different frequency ranges; and coupling means for coupling said dipole arms to a television receiver via said circuit means, said circuit means including a plurality of paired first and second inductors, the first inductor and the second inductor of each pair of inductors having a common inductance, the inductors of each pair differing in inductance from the inductors of other pairs, said switch means including means for selectively connecting said dipole arms to said coupling means via alternate pairs of said first and second inductors so that the first inductor of a pair is operatively connected in one circuit configuration to one of said dipole arms and the associated second inductor is operatively connected in another circuit configuration to the other of said dipole arms.

2. The device defined in claim 1 wherein all of said first inductors are connected at one end to one another and all of said second inductors are connected at one end to one another.

3. The device defined in claim 1 wherein said inductors are ferrite inductors.

4. The device defined in claim 1 wherein said coupling means includes a balun transformer and a balanced two-wire transmission line connected at one end to said switch means and at an opposite end to said balun transformer, said coupling means also including an unbalanced coaxial transmission line extending from said balun transformer and means connected to said unbalanced coaxial transmission line for operatively linking said unbalanced coaxial transmission line to the television receiver.

5. The device defined in claim 4 wherein said balun transformer is a ferrite component with an impedance ratio of 1:1.

6. The device defined in claim 1 wherein said circuit means further includes at least one coaxial series tuned circuit disposed in each of said dipole arms for suppressing current flow over electromagnetic frequencies corresponding to higher VHF channels.

7. The device defined in claim 1 wherein said support means includes a base part and tubular vertical extension connected to said base part, said dipole arms extending from an upper end of said extension.

8. The device defined in claim 7, further comprising a balun transformer and a balanced two-wire transmission line connected at one end to said switch means and at an opposite end to said balun transformer, also comprising an unbalanced coaxial transmission line extending from said balun transformer and means connected to said unbalanced coaxial transmission line for coupling said unbalanced coaxial transmission line to a television receiver.

9. The device defined in claim 8 wherein said extension houses said balun transformer, said circuit means, and at least a portion of said switch means.

10. The device defined in claim 8 wherein said means for coupling includes a single-pole double-throw switch for alternately permitting connection of the antenna device or a video playback unit to the television receiver.

11. The device defined in claim 8 wherein said balun transformer is a ferrite component with an impedance ratio of 1:1.

12. The device defined in claim 1 wherein each of said dipole arms has at least one elbow type joint for enabling a bending of the respective arm from a fully extended configuration to a completely folded back configuration.

13. The device defined in claim 1 wherein each of said dipole arms includes at least one coaxial series tuned circuit for suppressing current flow over electromagnetic frequencies corresponding to higher VHF channels.

14. A television antenna device comprising:

a pair of electrically conductive dipole arms each including at least one coaxial series tuned circuit for suppressing current flow over electromagnetic frequencies corresponding to higher VHF channels;

support means attached to said dipole arms for supporting said dipole arms; and coupling means connectable to a television receiver, said coupling means including electrical circuit means operatively connected to each of said dipole arms and mounted to said support means for tuning said dipole arms for an optimal impedance match over a plurality of different frequency ranges, said coupling means further including switch means operatively connected to said circuit means and mounted to said support means for adjusting a circuit configuration including said circuit means and said dipole arms to selectively tune said dipole arms for an optimal impedance match over said plurality of different frequency ranges;

said circuit means including a plurality of paired first and second inductors, the first inductor and the second inductor of each pair of inductors having a common inductance, the inductors of each pair differing in inductance from the inductors of other pairs, all of said first inductors being connected at one end to one another and all of said second inductors being connected at one end to one another, said switch means including means for selectively connecting said dipole arms to said coupling means via alternate pairs of said first and second inductors so that the first inductor of a pair is operatively connected in one circuit configuration to one of said dipole arms and the associated second inductor is operatively connected in another circuit configuration to the other of said dipole arms.

15. The device defined in claim 14 wherein said coupling means includes a balun transformer and a balanced two-wire transmission line connected at one end to said switch means and at an opposite end to said balun transformer, said coupling means also including an unbalanced coaxial transmission line extending from said balun transformer and means connected to said unbalanced coaxial transmission line for operatively linking said unbalanced coaxial transmission line to the television receiver.

16. The device defined in claim 14, further comprising a balun transformer and a balanced two-wire transmission line connectable at one end to said dipole arms and connected at an opposite end to said balun transformer, also comprising an unbalanced coaxial transmission line extending from said balun transformer and means connected to said unbalanced coaxial transmission line for coupling said unbalanced coaxial transmission line to said television receiver.

17. The device defined in claim 14 wherein each of said dipole arms has at least one elbow type joint for enabling the bending of the respective arm from a fully extended configuration to a completely folded back configuration.

18. A television antenna device comprising:

a pair of electrically conductive dipole arms;

coupling means connectable to a television receiver;

a plurality of paired first and second inductors, the first and second inductor of each pair of inductors having a common inductance, the inductors of each pair differing in inductance from the inductors of other pairs, all of said first inductors being connected at one end to one another and all of said second inductors being connected at one end to one another;

a housing containing said inductors, said dipole arms being mounted to said housing; and switch means mounted to said housing for alternately connecting one of said dipole arms to said coupling means via different ones of said first inductors and concomitantly connecting the other of said dipole arms to said coupling means via associated ones of said second inductors, thereby tuning said dipole arms for an optimal impedance match over a plurality of different frequency ranges.

19. The device defined in claim 18 wherein said coupling means includes a balun transformer and a balanced two-wire transmission line connectable at one end to said dipole arms via said switch means and said inductors and at an opposite end to said balun transformer, said coupling means also including an unbalanced coaxial transmission line extending from said balun transformer and means connected to said unbalanced coaxial transmission line for operatively linking said unbalanced coaxial transmission line to the television receiver.

20. The device defined in claim 19 wherein said balun transformer is a ferrite component with an impedance ratio of 1:1.

21. The device defined in claim 19 wherein said means for coupling includes a single-pole double-throw switch for alternately permitting connection of the antenna device or a video playback unit to the television receiver.

22. The device defined in claim 18 wherein said inductors are ferrite inductors.

23. The device defined in claim 18 wherein said housing includes a base part and tubular vertical extension connected to said base part, said dipole arms extending from an upper end of said extension.

24. The device defined in claim 18 wherein each of said dipole arms has at least one elbow type joint for enabling a bending of the respective arm from a fully extended configuration to a completely folded back configuration.

25. The device defined in claim 18 wherein each of said dipole arms includes at least one coaxial series tuned circuit for suppressing current flow over electromagnetic frequencies corresponding to higher VHF channels.

* * * * *